US009537250B2

(12) United States Patent
Kao et al.

(10) Patent No.: US 9,537,250 B2
(45) Date of Patent: Jan. 3, 2017

(54) ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/719,799

(22) Filed: May 22, 2015

(65) Prior Publication Data

US 2015/0340798 A1 Nov. 26, 2015

(30) Foreign Application Priority Data

May 22, 2014 (TW) ..... 103208993 U
Feb. 13, 2015 (TW) ..... 104105188 A

(51) Int. Cl.
*H01R 24/00* (2011.01)
*H01R 13/516* (2006.01)
(Continued)

(52) U.S. Cl.
CPC ..... *H01R 13/516* (2013.01); *H01R 13/6594* (2013.01); *H01R 13/6582* (2013.01); *H01R 24/62* (2013.01)

(58) Field of Classification Search
CPC ..... H01R 24/60; H01R 23/02; H01R 24/62; H01R 13/648
(Continued)

(56) References Cited

U.S. PATENT DOCUMENTS 7,611,387 B1 * 11/2009 Zhang ..... H01R 12/725 439/660
7,862,346 B1 * 1/2011 Wan ..... H01R 12/712 439/607.04
(Continued)

FOREIGN PATENT DOCUMENTS

TW 201220615 5/2012
TW M432969 7/2012
(Continued)

*Primary Examiner* — Abdullah Riyami
*Assistant Examiner* — Nader Alhawamdeh
(74) *Attorney, Agent, or Firm* — Muncy, Geissler, Olds & Lowe, P.C.

(57) ABSTRACT

An electrical receptacle connector includes an insulated housing, plate terminals, and a metallic shell. The insulated housing includes a base portion. The plate terminals are at the insulated housing. The plate terminals include soldering segments exposed out of the bottom of the base portion. The metallic shell encloses four sides of the insulated housing and includes a top cover plate, a rear cover plate, and pins. The top cover plate is located atop the base portion. The rear cover plate is extending downwardly to the rear side of the base portion from the rear side of the top cover plate. The rear cover plate includes a bottom surface and a bent sheet substantially perpendicular to an outer wall of the rear cover plate and extended outward from the outer wall of the rear cover plate, and the pins are extending downwardly from the bottom surface.

19 Claims, 15 Drawing Sheets

(51) Int. Cl.
*H01R 13/6594* (2011.01)
*H01R 13/6582* (2011.01)
*H01R 24/62* (2011.01)

(58) Field of Classification Search
USPC ..... 439/660, 626
See application file for complete search history.

(56) References Cited

U.S. PATENT DOCUMENTS

| | | | | |
|---|---|---|---|---|
| 7,909,653 | B1 * | 3/2011 | Wan | H01R 13/514 439/660 |
| 8,398,438 | B2 * | 3/2013 | Zhang | H01R 13/6471 439/660 |
| 8,814,583 | B2 * | 8/2014 | Naito | H01R 24/60 439/188 |
| 2005/0186843 | A1 * | 8/2005 | Tsai | H01R 23/6873 439/607.36 |
| 2009/0042450 | A1 * | 2/2009 | Zheng | H01R 23/6873 439/660 |
| 2013/0059472 | A1 * | 3/2013 | Saito | H01R 13/648 439/607.27 |
| 2014/0065889 | A1 * | 3/2014 | Zhang | H01R 43/24 439/660 |
| 2015/0255925 | A1 * | 9/2015 | Katayanagi | H01R 24/76 439/108 |
| 2015/0380884 | A1 * | 12/2015 | Lee | H01R 24/60 439/676 |

FOREIGN PATENT DOCUMENTS

| | | |
|---|---|---|
| TW | 201232957 | 8/2012 |
| TW | M474278 | 3/2014 |
| TW | M511692 U | 11/2015 |

* cited by examiner

| | | | | | | | | | | | | |
|---|---|---|---|---|---|---|---|---|---|---|---|---|
| GND | RX2+ | RX2− | VBUS | RFU | D− | D+ | CC1 | VBUS | TX1− | TX1+ | GND | 211 |
| GND | TX2+ | TX2− | VBUS | CC2 | D+ | D− | RFU | VBUS | RX1− | RX1+ | GND | 212 |

Fig. 4D

ELECTRICAL RECEPTACLE CONNECTOR

CROSS-REFERENCES TO RELATED APPLICATIONS

This non-provisional application claims priority under 35 U.S.C. §119(a) on Patent Application No. 103208993 and 104105188, filed in Taiwan, R.O.C. on 2014 May 22 and 2015 Feb. 13, the entire contents of which are hereby incorporated by reference.

FIELD OF THE INVENTION

The instant disclosure relates to an electrical connector, and more particularly to an electrical receptacle connector.

BACKGROUND

Currently, the increase in the functionality of various electronic devices is driving the demand for smaller and smaller devices that are easier and more convenient for users to carry and use. This causes many electrical/electronic components within the device to be located closer together. This increases the possibility that the various electronic components in the device will suffer from electromagnetic interference (EMI) or radio frequency interference (RFI) either from RF components such as the antenna, microphone components, RF power amplifiers, etc and subsystems in the device and/or from external sources. The high speed electrical transmission in these devices can produce electromagnetic emissions, which may leak from the connection between the plug connector and its mating connector. These emissions can cause problems in high speed signal transmissions in that they can negatively influence wireless communication between two devices.

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use, from the end user's point of view. Now, as technology innovation marches forward, new kinds of devices, media formats and large inexpensive storage products are converging. They require significantly more bus bandwidth to maintain the interactive experience that users have come to expect. In addition, user applications demand a higher performance between the PC and sophisticated peripherals. The transmission rate of USB 2.0 is insufficient. Consequently, faster serial bus interfaces, such as USB 3.0, have been developed to address the need by adding a higher transmission rate to match usage patterns and devices.

Please refer to FIG. 1 and FIG. 2. FIG. 1 illustrates a perspective view of a conventional electrical receptacle connector, and FIG. 2 is a schematic view of EMI analysis of the conventional electrical receptacle connector. As shown, in the conventional electrical receptacle connector, the base portion and the terminals are received in the metallic shell A1. Therefore, the metallic shell enables the grounding of the conventional electrical receptacle connector and prevents signal interference when transmission. However, the rear cover plate A11 of the metallic shell A1 is devoid of pins. That is, a bottom edge A12 of the rear cover plate A11 is not provided with pins for soldering a circuit board with the metallic shell A1. Here, FIG. 2 is a schematic view of EMI simulation analysis for the conventional electrical receptacle connector mated with a plug electrical connector. It can be clearly seen that, the length of the rear cover plate A11 of the metallic shell A1 is so short, that the gap of between the bottom edge A12 of the rear cover plate A11 and terminal pins or the circuit board is greater than 1.0 mm. From the test results on the distribution of electromagnetic emission leakage, it can be known that a significant magnitude of electromagnetic emissions would leak from the gap, resulting in EMI and RFI problems during signal transmission. Moreover, regarding the rear cover plate A11 be devoid of pins, the securing force between the electrical receptacle connector and the circuit board would be insufficient. Therefore, aforementioned problems of the conventional connector are to be solved.

SUMMARY OF THE INVENTION

In view of the above problems, the instant disclosure provides an electrical receptacle connector comprising an insulated housing, a plurality of upper-row plate terminals, a plurality of lower-row plate terminals, and a metallic shell. The insulated housing comprises a base portion and a tongue portion extending from one side of the base portion. The tongue portion comprises an upper surface and a lower surface. The upper-row plate terminals comprise a plurality of upper-row plate signal terminals, at least one upper-row power terminal, and at least one upper-row plate ground terminal. Each of the upper-row plate terminals is held on the base portion and the tongue portion and at the upper surface. Each of the upper-row plate terminals comprises an upper-row contact segment, an upper-row connecting segment, and an upper-row soldering segment. For each upper-row plate terminal, the upper-row connecting segment is at the base portion and the tongue portion, the upper-row contact segment is extending from one of two ends of the upper-row connecting segment to be at the upper surface, and the upper-row soldering segment is extending from the other end of the upper-row connecting segment to protrude out of the base portion. The lower-row plate terminals comprise a plurality of lower-row plate signal terminals, at least one lower-row power terminal, and at least one lower-row ground terminal. Each of the low-row plate terminals is held on the base portion and the tongue portion and at the lower surface. Each of the lower-row plate terminals comprises a lower-row contact segment, a lower-row connecting segment, and a lower-row soldering segment. For each lower-row plate terminal, the lower-row connecting segment is at the base portion and the tongue portion, the lower-row contact segment is extending from one of two ends of the lower-row connecting segment to be at the lower surface, and the lower-row soldering segment is extending from the other end of the lower-row connecting segment to protrude out of the base portion. The metallic shell defines a receiving cavity therein. The insulated housing is in the metallic shell. The metallic shell comprises a top cover plate, a rear cover plate, and a plurality of pins. The top cover plate is located atop the base portion and the tongue portion. The rear cover plate is extending downwardly along the rear side of the base portion from the rear side of the top cover plate, and the rear cover plate comprises a bottom edge and a bent sheet substantially perpendicular to an outer wall of the rear cover plate and extended outward from the outer wall of the rear cover plate. The pins are extending downwardly from the bottom edge.

In conclusion, the rear cover plate has a plurality of pins to be soldered on the circuit board for reducing ground resistance and EMI. Moreover, the decrease of the spacing between the bottom edge of the rear cover plate and the circuit board effectively achieves desirable effects of EMI and RFI reductions. In addition, the pins improve the securing force between the electrical receptacle connector and the circuit board, so that the electrical receptacle connector would have desirable bending test results and wrenching strength. Besides, since the upper-row plate terminals and the lower-row plate terminals are arranged upside down, and the pin configuration of the upper-row plate signal terminals is left-right reversal with respect to that of the lower-row plate signal terminals. Accordingly, when the electrical plug connector is inserted into the electrical receptacle connector by a first orientation where the upper plane of the electrical plug connector is facing up, the upper-row elastic terminals of the electrical plug connector are in contact with the upper-row plate signal terminals of the electrical receptacle connector. Conversely, when the electrical plug connector is inserted into the electrical receptacle connector by a second orientation where the lower plane of the electrical plug connector is facing up, the upper-row elastic terminals of the electrical plug connector are in contact with the lower-row plate signal terminals of the electrical receptacle connector. Consequently, the inserting orientation of the electrical plug connector is not limited when inserting into the electrical receptacle connector.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 4D is a schematic configuration diagram of the plate terminals of the electrical receptacle connector shown in FIG. 4C;

DETAILED DESCRIPTION

Figure 1:
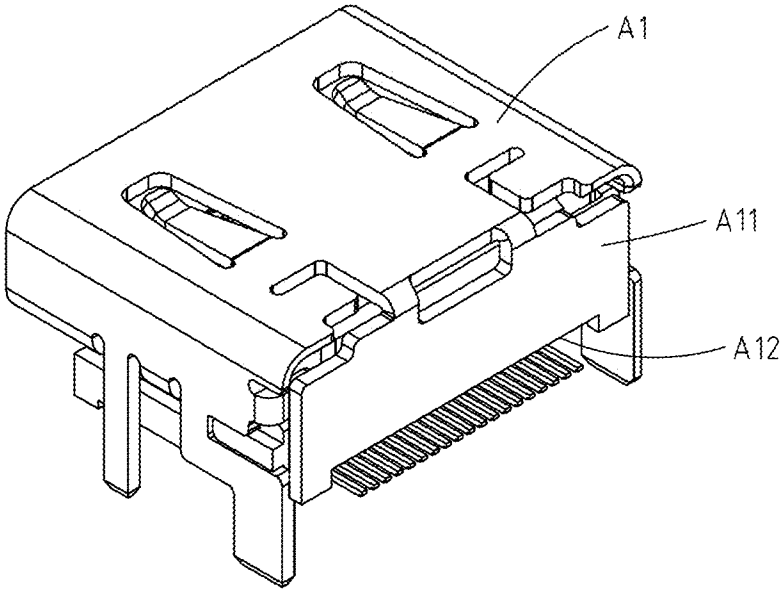
Fig. 1 (Prior art)
FIG. 1 is a perspective view of a conventional electrical receptacle connector.
Figure 2:
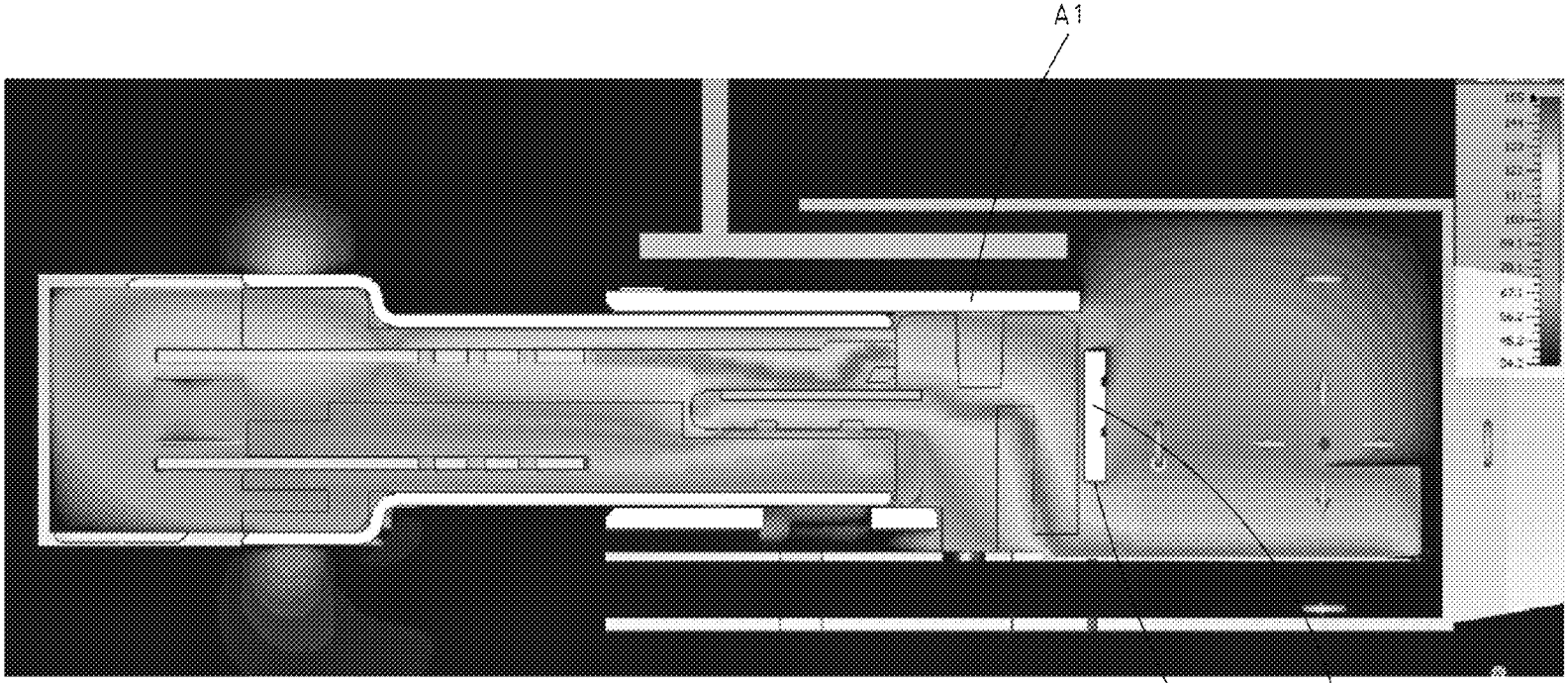
Fig. 2 (Prior art)
FIG. 2 is a schematic view of EMI analysis for the conventional electrical receptacle connector.
Figure 3:
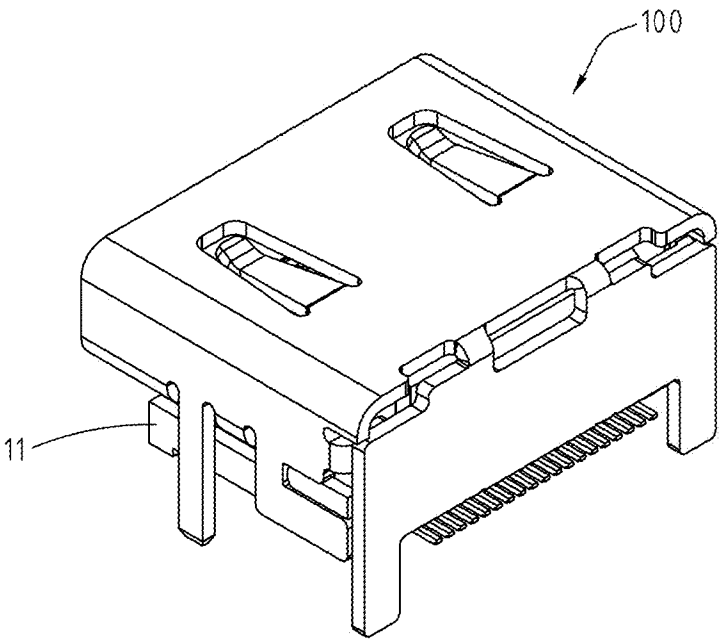
FIG. 3 illustrates a perspective view of an exemplary embodiment of an electrical receptacle connector according to the instant disclosure.
Figure 4:
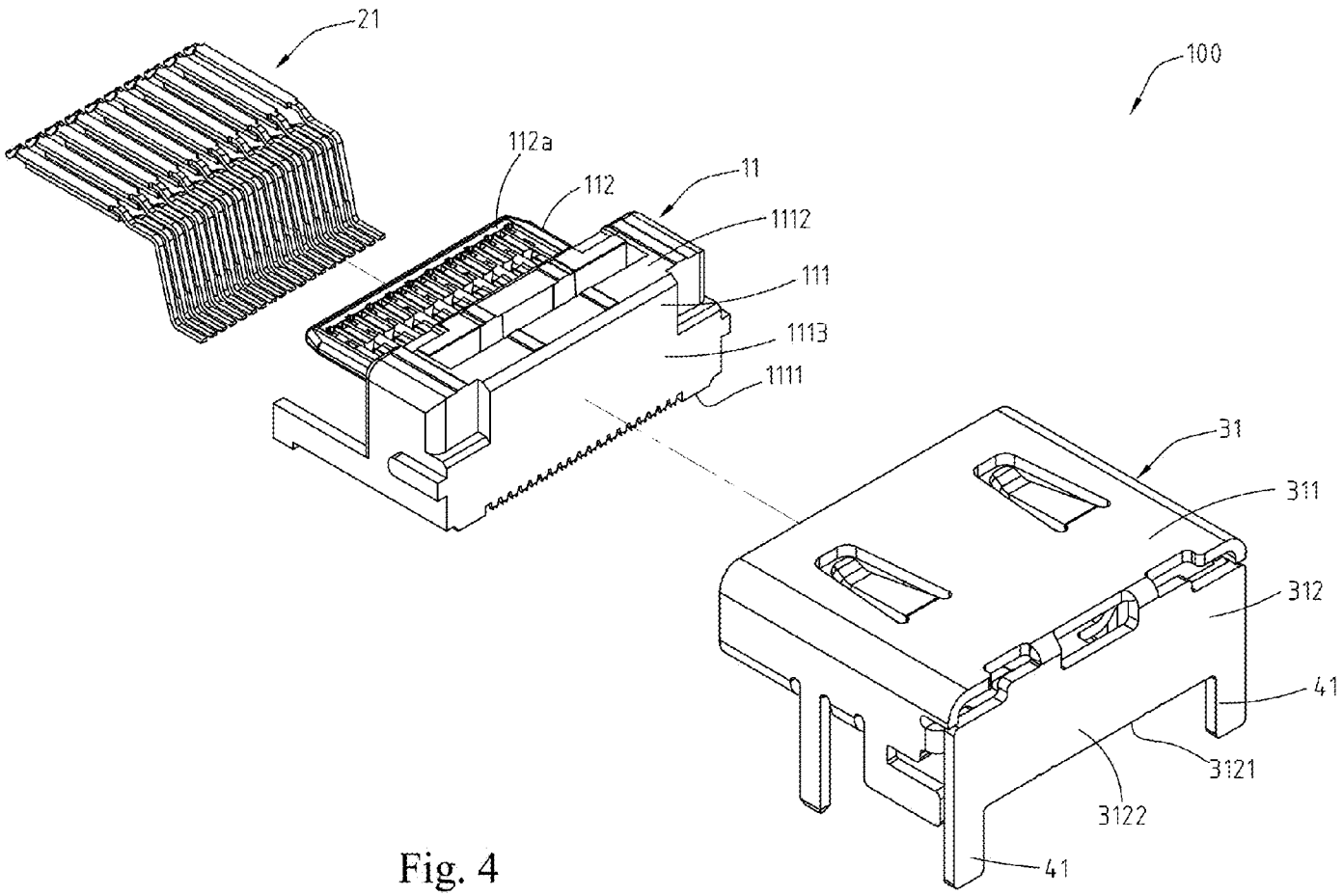
FIG. 4 illustrates an exploded view of the electrical receptacle connector according to the instant disclosure.
Figure 5:
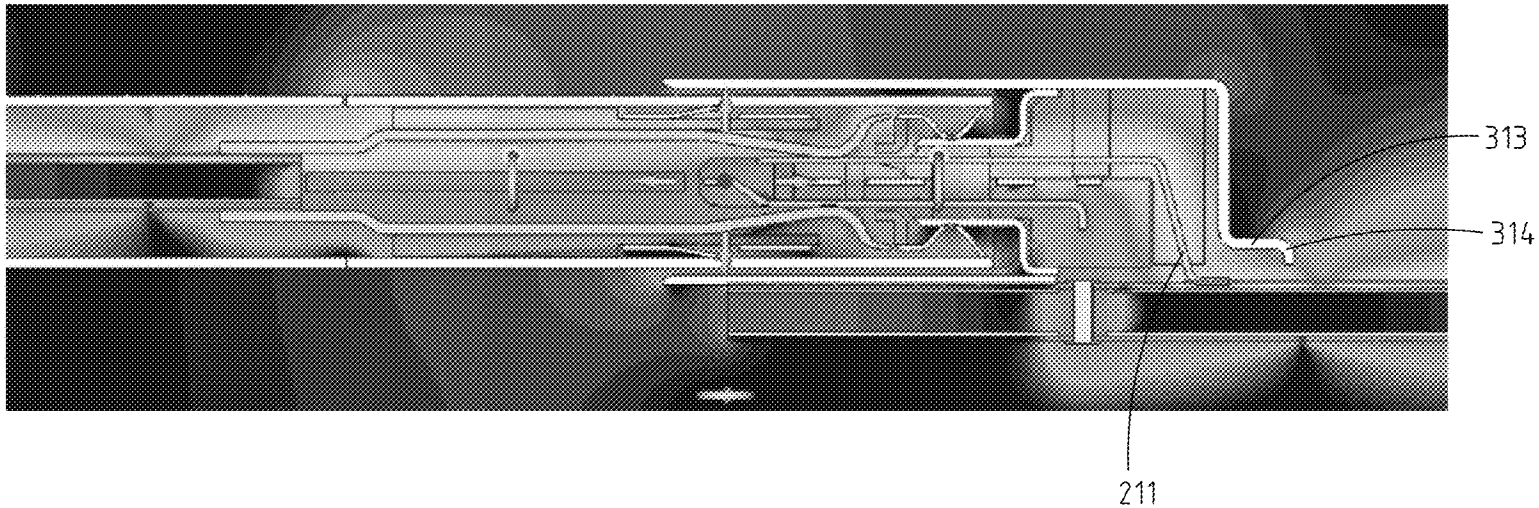
FIG. 5 is a schematic view of EMI analysis for the electrical receptacle connector according to the instant disclosure.
Figure 6:
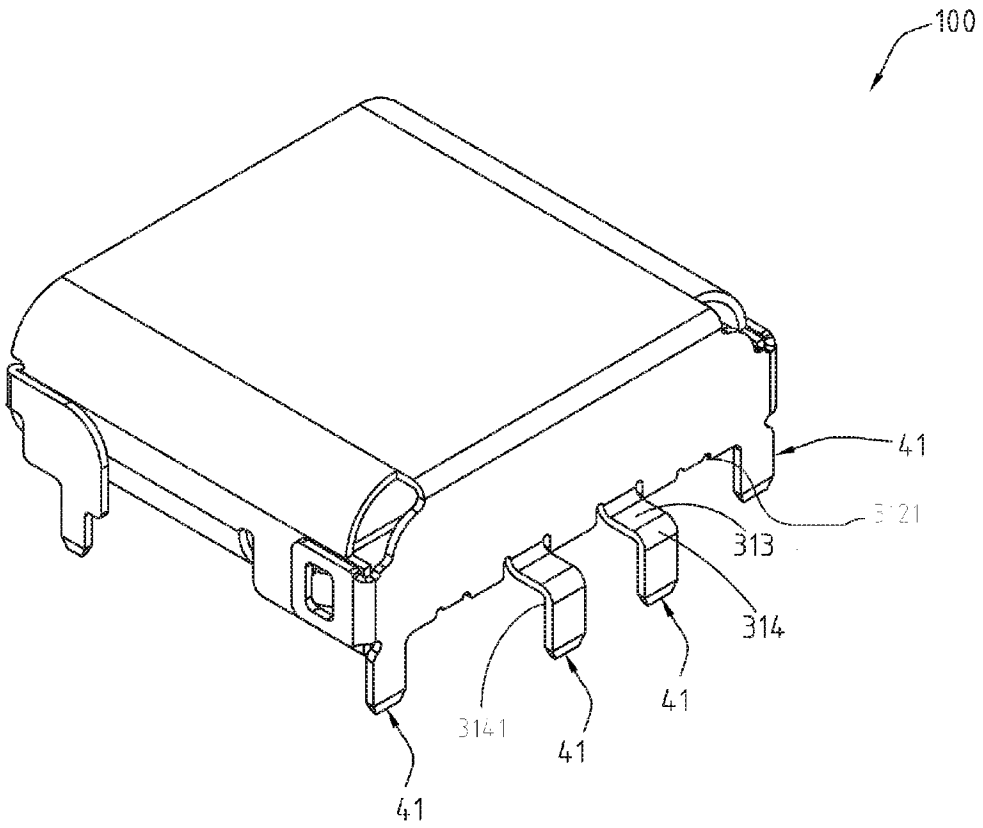
FIG. 6 illustrates a perspective view of an electrical receptacle connector provided with a bent sheet extending from a rear cover plate, according to the instant disclosure.

Please refer to FIG. 3, FIG. 4, and FIG. 5, illustrating an exemplary embodiment of an electrical receptacle connector 100 according to the instant disclosure. FIG. 3 illustrates a perspective view of the electrical receptacle connector 100. FIG. 4 illustrates an exploded view of the electrical receptacle connector 100. FIG. 5 is a schematic view of EMI analysis for the electrical receptacle connector 100. Here, the electrical receptacle connector 100 may be of a Type-C USB connection interface specification (as shown in FIG. 6). In this embodiment, the electrical receptacle connector 100 comprises an insulated housing 11, a plurality of receptacle terminals 21, and a metallic shell 31.

Figure 4A:
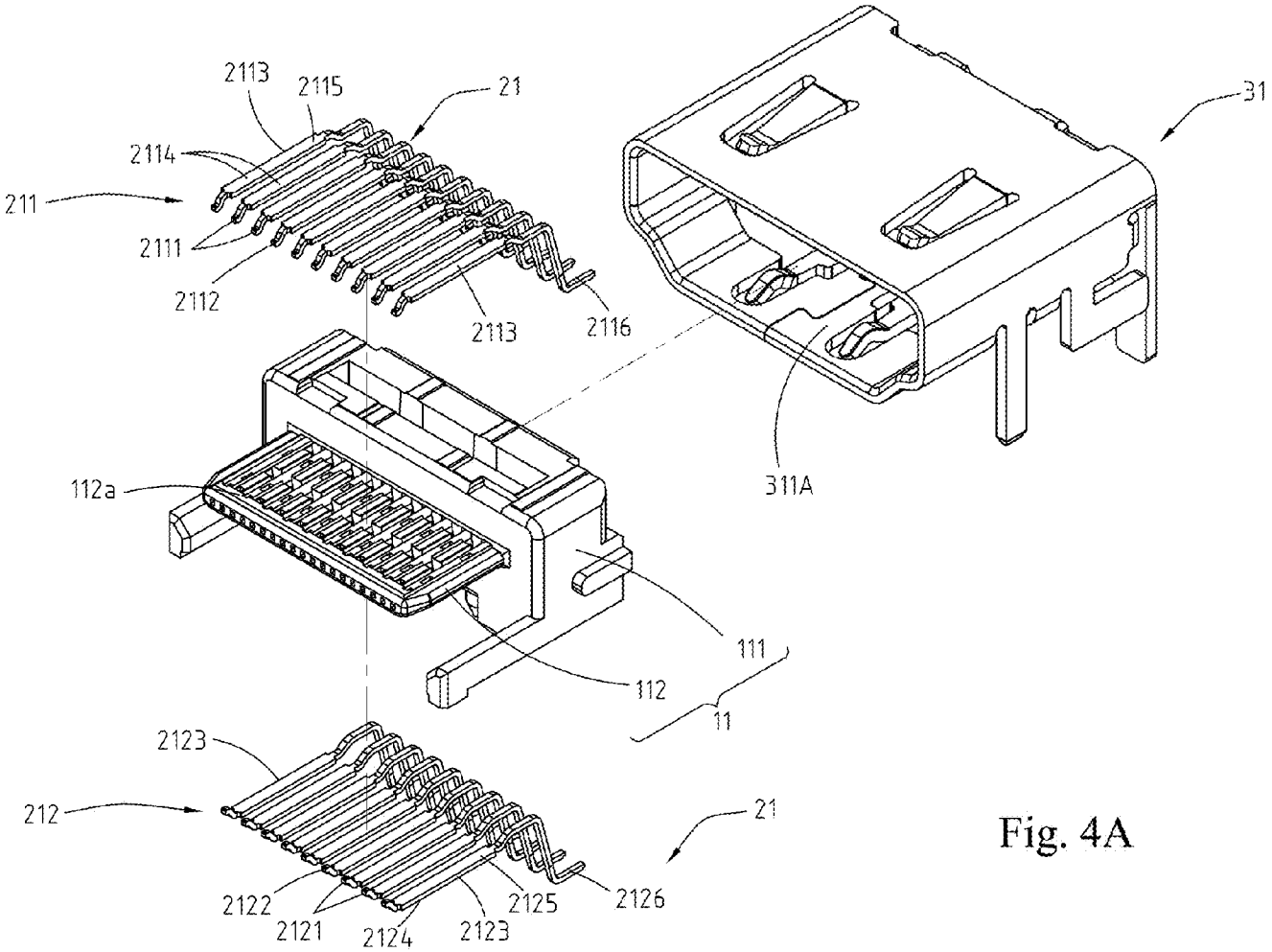
FIG. 4A illustrates an exploded view of the electrical receptacle connector according to the instant disclosure, for one variation.

Please refer to FIG. 4 and FIG. 5, in which the insulated housing 11 is an elongate member, and the insulated housing 11 comprises a base portion 111 and a tongue portion 112. Here, the base portion 111 and the tongue portion 112 are formed by insert-molding technique, and the tongue portion 112 is extending from one side of the base portion 111. In addition, the tongue portion 112 has an upper surface 112*a* and a lower surface 112*b* (as shown in FIG. 4A and FIG. 4B).

Figure 4B:
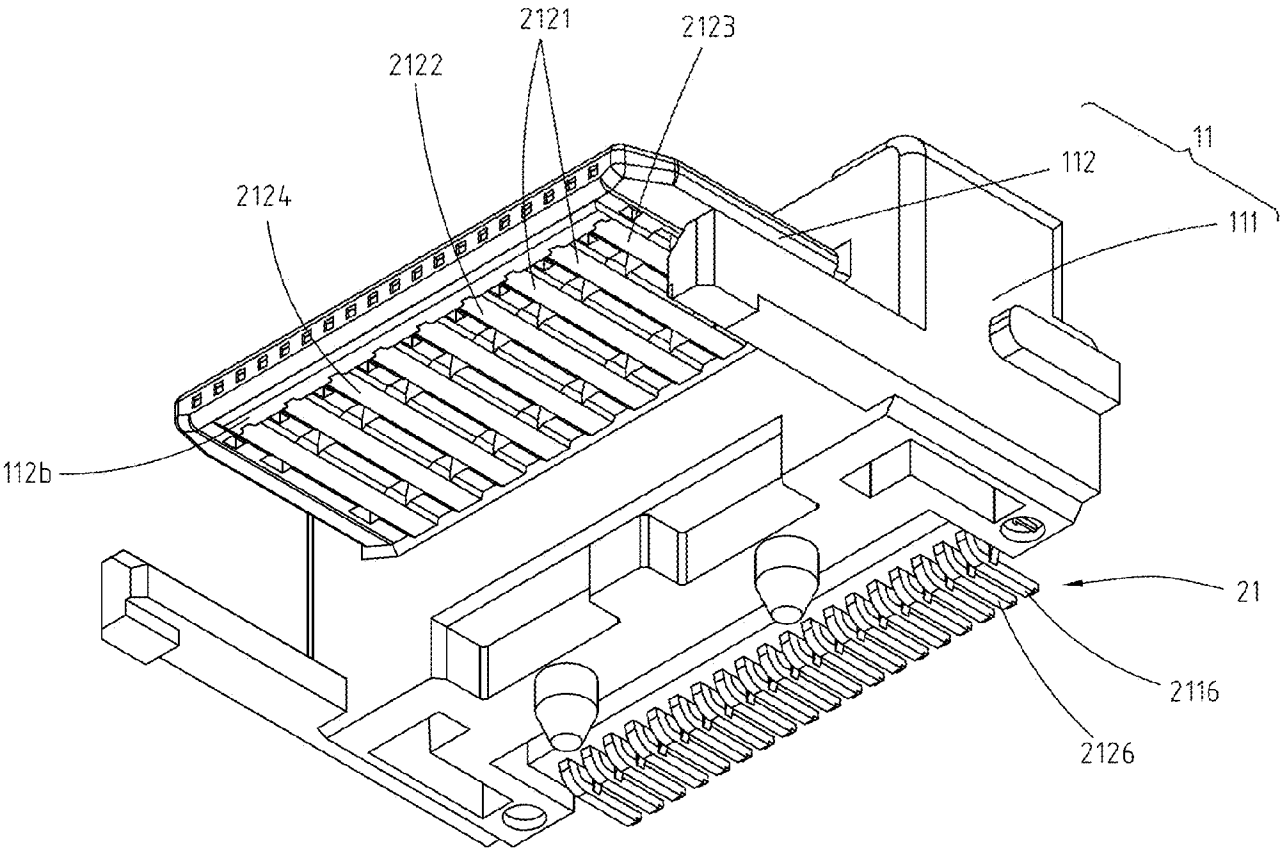
FIG. 4B illustrates another perspective view of the electrical receptacle connector according to the instant disclosure.
Figure 4C:
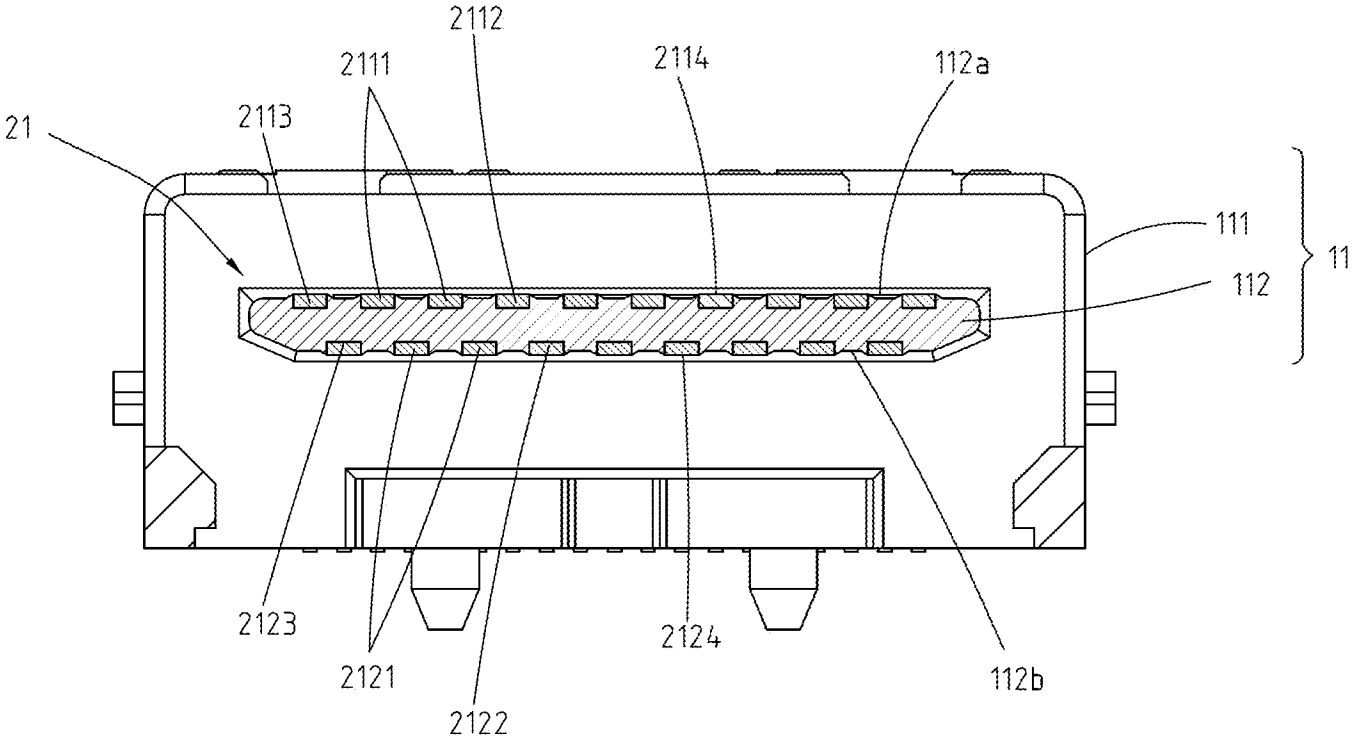
FIG. 4C illustrates a front sectional view of the electrical receptacle connector according to the instant disclosure.

The receptacle terminals 21 are held on the base portion 111 and the tongue portion 112 (as shown in FIG. 4B and FIG. 4C). The receptacle terminals 21 comprise a plurality of upper-row plate tetminals 211 and a plurality of lower-row plate terminals 212. The electrical receptacle connector 100 can be HDMI or USB Type-C format, and the pin assignment could be different.

Please refer to FIG. 4A to 4D, in which the upper-row plate terminals 211 are held on the base portion 111 and the tongue portion 112. Here, the upper-row plate terminals 211 comprise a plurality of upper-row plate signal terminals 2111, at least one upper-row plate power terminal 2112, and at least one upper-row plate ground terminal 2113. The upper-row plate terminals 211 are at the upper surface 112*a*. As shown in FIG. 4D, the electrical receptacle connector 100 of the embodiment is the USB Type-C format, the upper-row plate terminals 211 comprise, from left to right, an upper-row plate ground terminal 2113 (Gnd), a first pair of differential signal terminals (TX1+−), a second pair of differential signal terminals (D+−), and a third pair of differential signal terminals (RX2+−), of the upper-row plate signal terminals 2111, upper-row plate power terminals 2112 (Power/VBUS), between the three pairs of differential signal terminals, a retain terminal (RFU), (the retain terminal and a configuration channel 1 (CC1) are respectively arranged between the upper-row plate power terminals 2112 (Power/VBUS) and the second pair of differential signal terminals of the upper-row plate signal terminals 2111), and an upper-row plate ground terminal 2113 (Gnd) at the rightmost side.

Please refer to FIG. 4A to 4D, in which the upper-row plate terminals 211 are held on the base portion 111 and the tongue portion 112. Each of the upper-row plate terminals 211 comprises an upper-row plate contact segment 2114, an upper-row plate connecting segment 2115, and an upper-row plate soldering segment 2116. For each upper-row plate terminal 211, the upper-row plate connecting segment 2115 is at the base portion 111 and the tongue portion 112, the upper-row plate contact segment 2114 is extending from one of two ends of the upper-row plate connecting segment 2115 and at the upper surface 112*a*, and the upper-row plate soldering segment 2116 is extending from the other end of the upper-row plate connecting segment 2115 and protruded out of the base portion 111. The upper-row plate signal terminals 2111 are at the upper surface 112*a* for transmitting first signals (i.e., USB 3.0 signals). The upper-row plate soldering segments 2116 are protruded out of the bottom surface of the base portion 111. Moreover, the upper-row plate soldering segments 2116 are horizontally aligned and provided as pins, i.e. horizontal pins. (as shown in FIG. 4B).

Please refer to FIG. 4A to 4D, in which the lower-row plate terminals 212 are held on the base portion 111 and the tongue portion 112. Here, the lower-row plate terminals 212 comprise a plurality of lower-row plate signal terminals 2121, at least one lower-row plate power terminal 2122, and at least one lower-row plate ground terminal 2123. The lower-row plate terminals 212 are at the lower surface 112*b*. As shown in FIG. 4D, the electrical receptacle connector 100 of the embodiment is the USB Type-C format, the lower-row plate terminals 212 comprise, from left to right, a lower-row plate ground terminal 2123 (Gnd), a first pair of differential signal terminals (TX2+−), a second pair of differential signal terminals (D+−), and a third pair of differential signal terminals (RX1+−), of the lower-row plate signal terminals 2121, lower-row plate power terminals 2122 (Power/VBUS), between the three pairs of differential signal terminals, a retain terminal (RFU), (the retain terminal and a configuration channel 2 (CC2) are respectively arranged between the lower-row plate power terminals 2122 (Power/VBUS) and the second pair of differential signal terminals of the lower-row plate signal terminals 2121), and a lower-row plate ground terminal 2123 (Gnd) at the rightmost side.

Please refer to FIG. 4A to 4D, in which the lower-row plate terminals 212 are held on the base portion 111 and the tongue portion 112. Each of the lower-row plate terminals 212 comprises a lower-row plate contact segment 2124, a lower-row plate connecting segment 2125, and a lower-row plate soldering segment 2126. For each lower-row plate terminal 212, the lower-row plate connecting segment 2125 is at the base portion 111 and the tongue portion 112, the lower-row plate contact segment 2124 is extending from one of two ends of the lower-row plate connecting segment 2125 and at the lower surface 112*b*, and the lower-row plate soldering segment 2126 is extending from the other end of the lower-row plate connecting segment 2125 and protruded out of the base portion 111. The lower-row plate signal terminals 2121 are at the lower surface 112*b* for transmitting second signals (i.e., USB 3.0 signals). The lower-row plate soldering segments 2126 are protruded out of the bottom surface of the base portion 111. Moreover, the lower-row plate soldering segments 2126 are bent downwardly and provided as vertical pins (as shown in FIG. 4B).

Please refer to FIG. 4 and FIG. 4A to 4D, in which embodiment, the upper-row plate terminals 211 and the lower-row plate terminals 212 are respectively at the upper surface 112*a* and the lower surface 112*b* of the tongue portion 112. Additionally, as shown in FIG. 4D, the pin assignment of the upper-row plate terminals 211 and the lower-row plate terminals 212 are point-symmetrical with a central point of the receptacle cavity 311A as the symmetrical center. Here, point-symmetry means that after the upper-row plate terminals 211 (or the lower-row plate terminals 212), are rotated by 180 degrees with the symmetrical center as the rotating center, the upper-row plate terminals 211 and the lower-row plate terminals 212 are overlapped.

That is, the rotated upper-row plate terminals 211 are arranged at the position of the original lower-row plate terminals 212, and the rotated lower-row plate terminals 212 are arranged at the position of the original upper-row plate terminals 211. In other words, the upper-row plate terminals 211 and the lower-row plate terminals 212 are arranged upside down, and the pin configuration of the upper-row plate terminals 211 are left-right reversal with respect to the pin configuration of the lower-row plate terminals 212. Accordingly, an electrical plug connector is inserted into the electrical receptacle connector 100 with a first orientation where the upper plane of the electrical plug connector is facing up for transmitting first signals. Conversely, the electrical plug connector is inserted into the electrical receptacle connector 100 with a second orientation where the lower plane of the electrical plug connector is facing up for transmitting second signals. Besides, the specification for transmitting the first signals is conformed to the specification for transmitting the second signals. Note that, the inserting orientation of the electrical plug connector is not limited by the electrical receptacle connector 100.

Please refer to FIG. 4D, in which the position of the upper-row plate terminal 211 corresponds to the position of the lower-row plate terminals 212.

Please refer to FIG. 4 and FIG. 5. The metallic shell 31 is a hollow shell. The metallic shell 31 defines a receptacle cavity 311A therein. The metallic shell 31 encloses the insulated housing 11, namely, the insulated housing 11 is held in the metallic shell 31. In this embodiment, the metallic shell 31 comprises a top cover plate 311, a rear cover plate 312, and a plurality of pins 41. The top cover plate 311 is located atop the surface 1112 of the base portion 111 and the tongue portion 112, the rear cover plate 312 is extending downwardly to the rear side of the base portion 111 from the rear side of the top cover plate 311. The rear cover plate 312 comprises a bottom edge 3121. The pins 41 are extending downwardly from the bottom edge 3121. In this embodiment, the pins 41 are located at two sides of the rear cover plate 312, but embodiments are not limited thereto. The pins 41 are soldered on a circuit board 51, and the pins 41 are vertical pins. However, in some implementation aspects, the pins 41 may be pins, i.e. horizontal.

Please refer to FIG. 4 and FIG. 5. The metallic shell 31 may be further soldered on the circuit board 51. That is, the metallic shell 31 is located at the circuit board 51, and a distance between the bottom edge 3121 of the rear cover plate 312 and the circuit board 51 is less than or equal to 1.0 mm Here, FIG. 5 is a schematic view of EMI simulation analysis for the electrical receptacle connector 100 connected to a plug electrical connector. It can be clearly seen that, as compared to conventional, the length of the rear cover plate 312 of the metallic shell 31 is increased, such that the rear cover plate 312 is near to the circuit board 51. Moreover, the pins 41 are extending from the rear cover plate 312 to be soldered on the circuit board 51, such that the electromagnetic emissions can be effectively blocked by the rear cover plate 312 and further grounded and conducted by the pins 41 and the circuit board 51, according to the test results. Therefore, EMI or RFI noises can be reduced. In addition, the pins 41 improve the securing force between the electrical receptacle connector 100 and the circuit board 51, so that the electrical receptacle connector 100 would have desirable bending test results and wrenching strength. In this embodiment, the pins 41 are located at two sides of the rear cover plate 312, and the pins 41 of the rear cover plate 312 may avoid signal disconnection of the receptacle terminals 21 during a bending test.

Figure 7A:
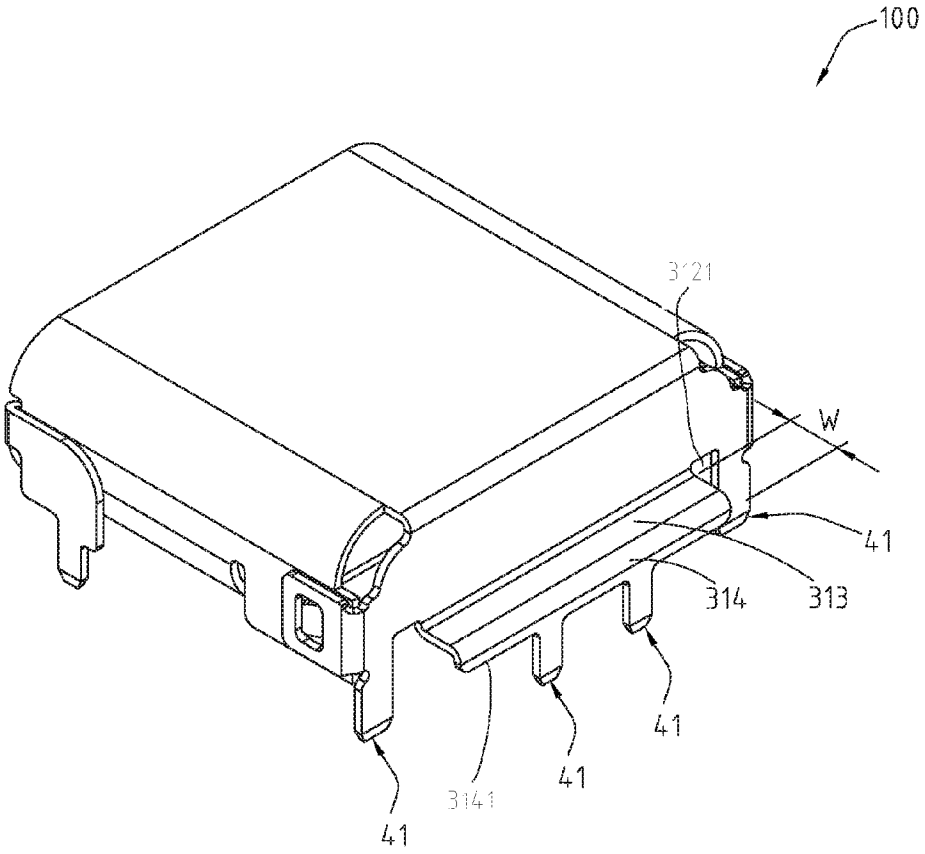
FIG. 7A illustrates a perspective view of an electrical receptacle connector provided with a bent sheet extending from a rear cover plate, according to the instant disclosure, for one variation.

FIG. 6 is a perspective view of an electrical receptacle connector 100 provided with a bent sheet 313 extending from the rear cover plate, according to the instant disclosure. In some embodiments, the rear cover plate 312 further comprises a bent sheet 313, the bent sheet 313 is substantially perpendicular to the rear cover plate 312, and the bent sheet 313 extends outward from an outer wall 3122 of the rear cover plate 312. Here, the bent sheet 313 is extending out of the outer wall 3122 of the rear cover plate 312 by a certain length W, and the certain length W is smaller than or equal to 1 mm (as shown in FIG. 7A). In addition, the bent sheet 313 comprises a corner 314 located at an end portion of the bent sheet 313, and the corner 314 includes a bottom edge 3141. That is, a part of the pins 41 extend downwardly from the bottom edge 3121 of the rear cover plate 312 and a part of the pins extend downwardly from the bottom edge 3141 of the corner 314. Moreover, the pins 41 are vertical pins. Here, the pins 41 are arranged at the middle part of the rear cover plate 312 to achieve a better effect of EMI or RFI mitigation.

Figure 7B:
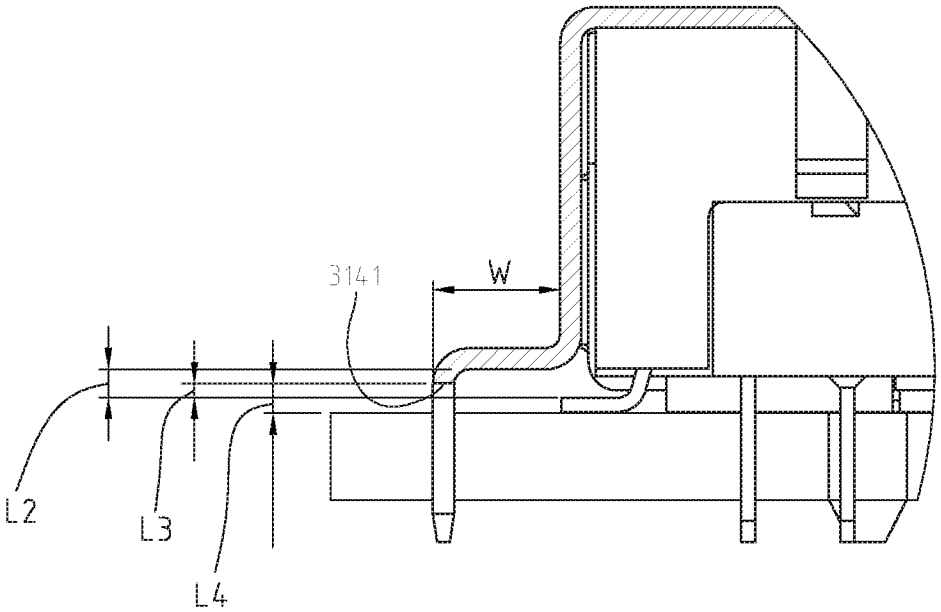
FIG. 7B illustrates a lateral view of the electrical receptacle connector shown in FIG. 7A.

Please refer to FIG. 7A and FIG. 7B, in which embodiment, the distance L3 between the upper-row soldering segments 2116 (or the lower-row soldering segments 2126) and the bottom edge 3141 of the corner 314 is less than or equal to 0.2 mm, and the distance L4 between the bottom edge 3141 of the corner 314 and the circuit board 51 is less than or equal to a range from 0.2 mm to 0.5 mm. When the soldering segments 2116, 2126 and the pins 41 are soldered on contacts of the circuit board 51, the soldering tins on the circuit board would not abut against the bottom edge 3141 of the corner to lift the rear cover plate 312 upward due to a spacing is confined between the bottom edge 3141 of the corner 314 and the circuit board 51.

Please refer to FIG. 6, in which embodiment, the width of the bent sheet 313 is equal to that of the pins 41, but embodiments are not limited thereto. In some embodiments, the width of the bent sheet 313 is greater than that of the pins 41, the bent sheet 313 is formed as an elongated plate, and the width of the bent sheet 313 is slightly less than that of the rear cover plate 312 as shown in FIG. 7A and FIG. 7B. Here, a plurality of pins 41 is located at the rear cover plate 312. Specifically, some pins 41 are located at the two sides of the rear cover plate 312, and the rest pins 41 are extending from the middle portion of the bent sheet 313, but the instant disclosure is not limited thereto. In some embodiments, the pins 41 are directly extending from two ends of the bent sheet 313. In addition, in some implementation aspects, two sides of the rear cover plate 312 is devoid of pins, and the pins 41 are configured at the bent sheet 313 to be soldered on the circuit board 51.

Figure 8:
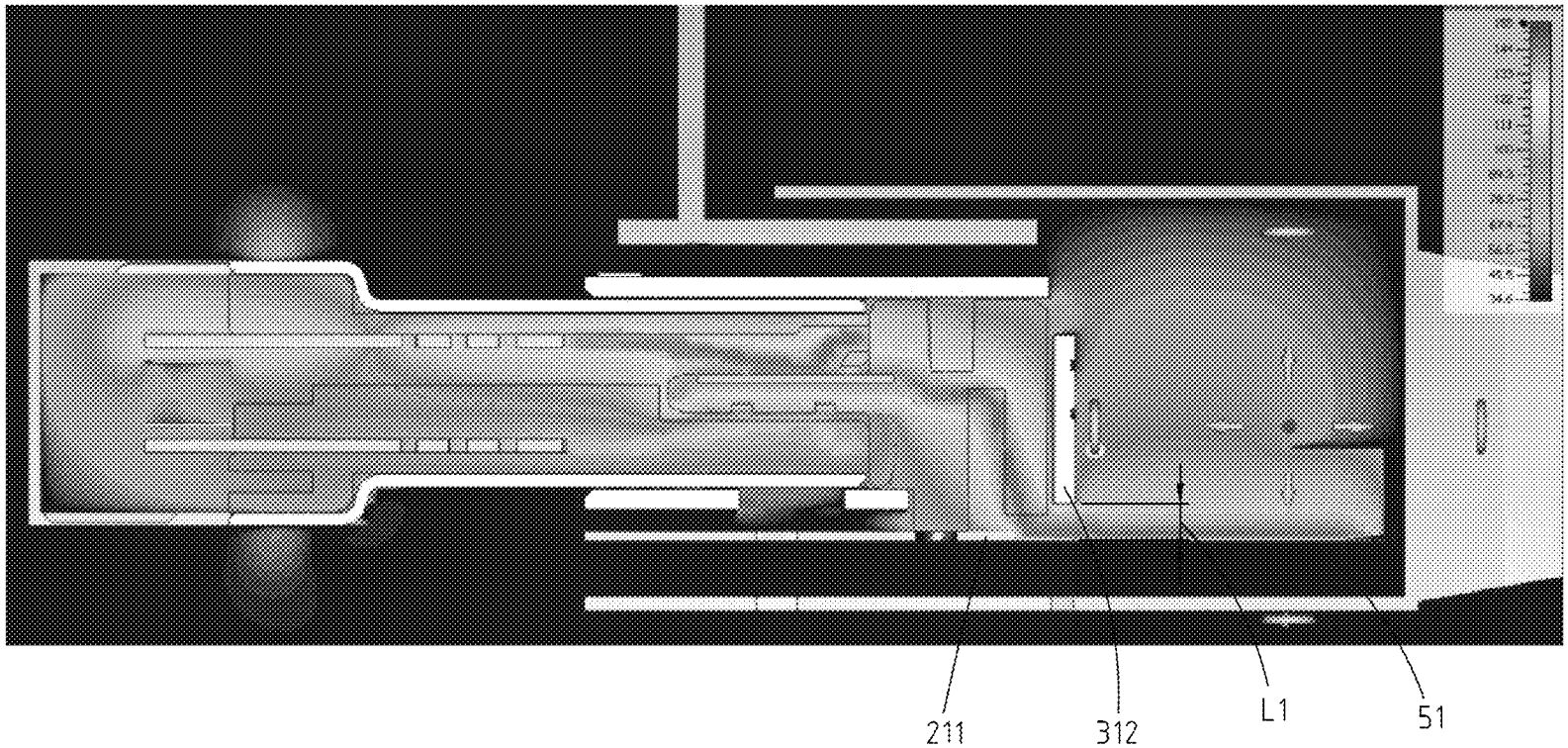
FIG. 8 is a schematic view of EMI analysis for the electrical receptacle connector shown in FIG. 7A.
Figure 9:
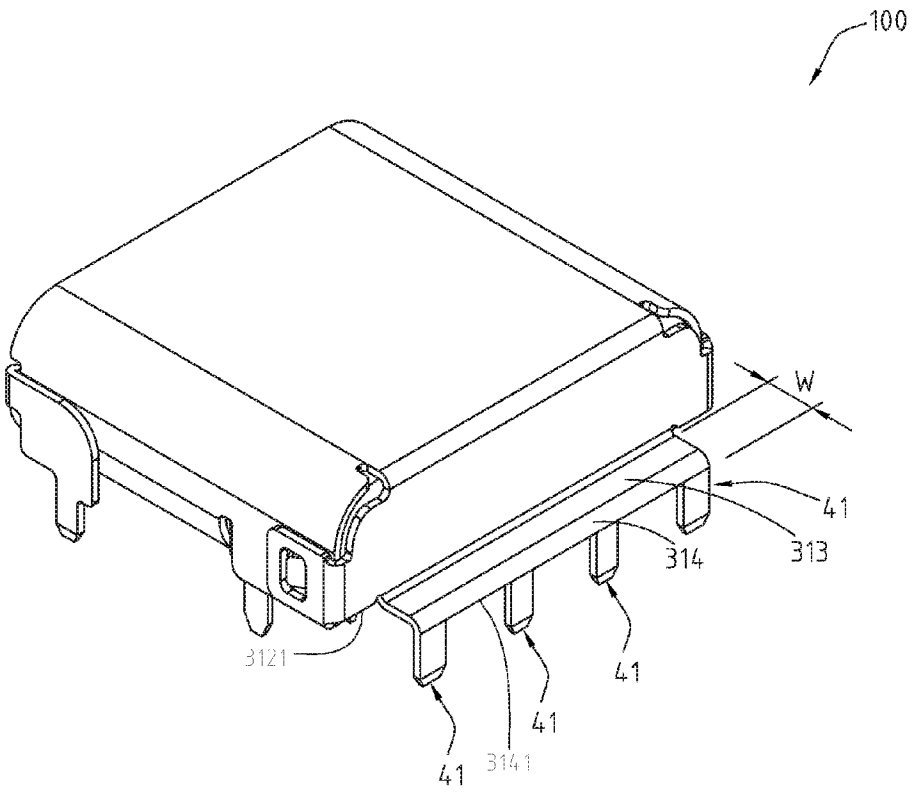
FIG. 9 illustrates a perspective view of an electrical receptacle connector according to the instant disclosure, where the bent sheet of the electrical receptacle connector is provided with a plurality of pins.
Figure 10:
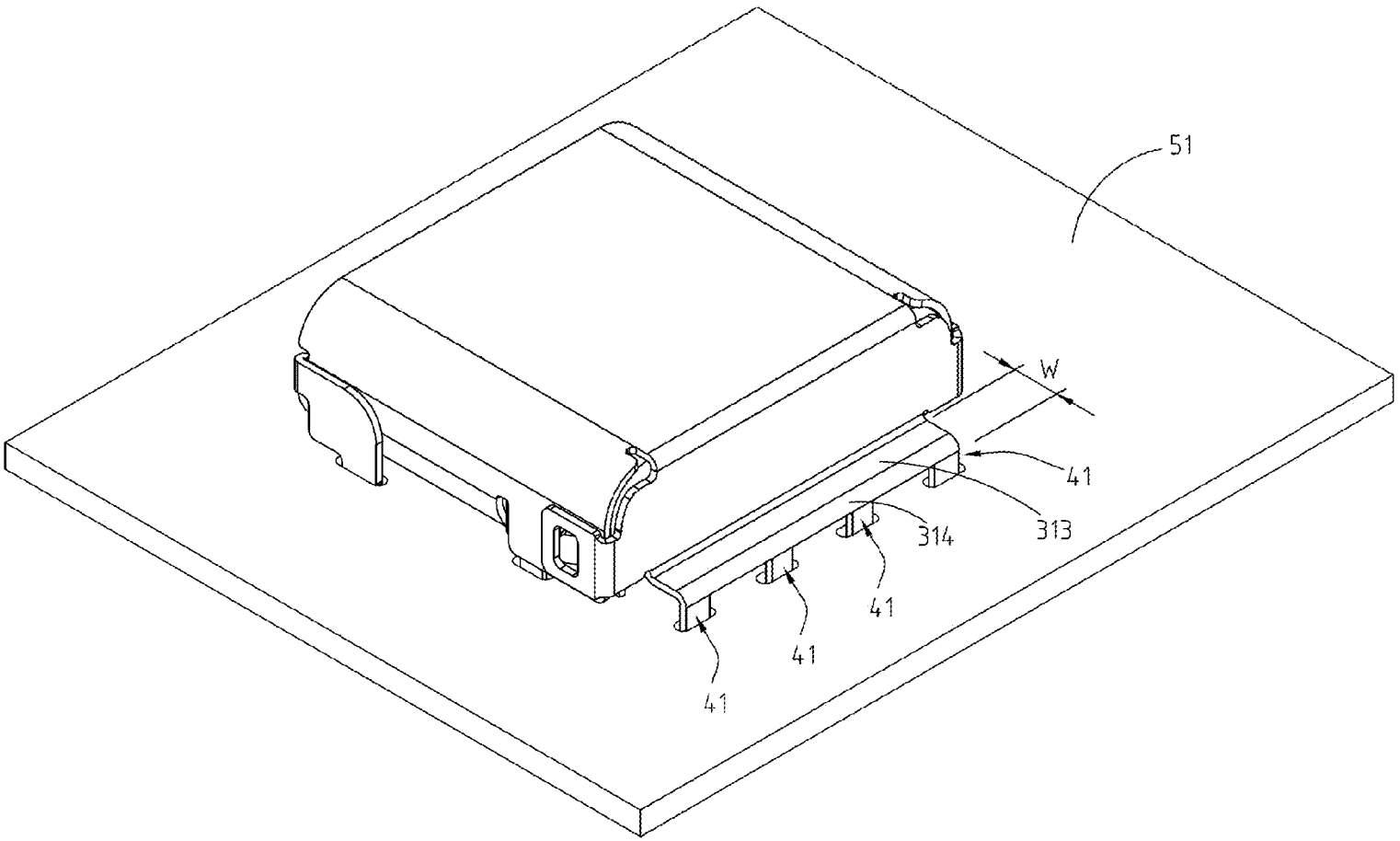
FIG. 10 illustrates a perspective view of an electrical receptacle connector assembled with a circuit board, according to the instant disclosure.

Please refer to FIG. 7A, FIG. 7B, and FIG. 8. FIG. 7A is a perspective view of an electrical receptacle connector provided with a bent sheet extending from a rear cover plate, according to the instant disclosure, for one variation. FIG. 7B is a lateral view of the electrical receptacle connector shown in FIG. 7A. FIG. 8 is a schematic view of EMI analysis for the electrical receptacle connector shown in FIG. 7A. In some embodiments, the upper-row soldering segments 2116 and the lower-row soldering segment 2126 are pins, i.e. horizontal pins, the upper-row soldering segments 2116 and the lower-row soldering segments 2126 are further near to the bottom of the bent sheet 313, and a distance L2 between the upper-row soldering segments 2116 (or the lower-row soldering segments 2126) and the bent sheet 313 is less than or equal to 0.4 mm.

Here, FIG. 8 is a schematic view of EMI analysis for the electrical receptacle connector shown in FIG. 7A, where the electrical receptacle connector 100 is connected to a plug electrical connector. It can be clearly seen that, as compared to conventional, the length of the rear cover plate 312 of the metallic shell 31 in increased, such that the rear cover plate 312 is near to the circuit board 51. Moreover, the pins 41 are extending from the bent sheet 313 of the rear cover plate 312 to be soldered on the circuit board 51 (as shown in FIG. 6, FIG. 7A, FIG. 9, and FIG. 10), such that the electromagnetic emissions cam be effectively blocked by the rear cover plate 312 and further grounded and conducted by the pins 41 and the circuit board 51, according to the test results. Therefore, EMI or RFI noises can be reduced. In addition, the pins 41 improve the securing force between the electrical receptacle connector 100 and the circuit board 51, so that the electrical receptacle connector 100 would have desirable bending test results and wrenching strength. In this embodiment, the pins 41 are located at two sides of the rear cover plate 312, and the pins 41 of the rear cover plate 312 may avoid signal disconnection of the receptacle terminals 21 during a bending test.

In conclusion, the rear cover plate has a plurality of pins to be soldered on the circuit board for reducing ground resistance and EMI. Moreover, the decrease of the spacing between the bottom surface edge of the rear cover plate and the circuit board effectively achieves desirable effects of EMI and RFI reductions. In addition, the pins improve the securing force between the electrical receptacle connector and the circuit board, so that the electrical receptacle connector would have desirable bending test results and wrenching strength. Besides, since the upper-row plate terminals and the lower-row plate terminals are arranged upside down, and the pin configuration of the upper-row plate signal terminals is left-right reversal with respect to that of the lower-row plate signal terminals. Accordingly, when the electrical plug connector is inserted into the electrical receptacle connector by a first orientation where the upper plane of the electrical plug connector is facing up, the upper-row elastic terminals of the electrical plug connector are in contact with the upper-row plate signal terminals of the electrical receptacle connector. Conversely, when the electrical plug connector is inserted into the electrical receptacle connector by a second orientation where the lower plane of the electrical plug connector is facing up, the upper-row elastic terminals of the electrical plug connector are in contact with the lower-row plate signal terminals of the electrical receptacle connector. Consequently, the inserting orientation of the electrical plug connector is not limited when inserting into the electrical receptacle connector.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

an insulated housing comprising a base portion and a tongue portion extending from one side of the base portion, and the tongue portion comprising an upper surface and a lower surface;

a plurality of upper-row plate terminals comprising a plurality of upper-row plate signal terminals, at least one upper-row plate power supply terminal, and at least one upper-row plate ground terminal, wherein each of the upper-row plate terminals is held on the base portion and the tongue portion and is at the upper surface of the tongue portion, wherein each of the upper-row plate terminals comprises an upper-row contact segment, an upper-row connecting segment, and an upper-row soldering segment, the upper-row connecting segment is at the base portion and the tongue portion, the upper-row contact segment is extending from one of two ends of the upper-row connecting segment to be at the upper surface, and the upper-row soldering segment is extending from the other end of the upper-row connecting segment to protrude out of the base portion;

a plurality of lower-row plate terminals comprising a plurality of lower-row plate signal terminals, at least one lower-row plate power supply terminal, and at least one lower-row plate ground terminal, wherein each of the lower-row plate terminals is held on the base portion and the tongue portion and is at the lower surface of the tongue portion, wherein each of the lower-row plate terminals comprises a lower-row contact segment, a lower-row connecting segment, and a lower-row soldering segment, the lower-row connecting segment is at the base portion and the tongue portion, the lower-row contact segment is extending from one of two ends of the lower-row connecting segment to be at the lower surface, and the lower-row soldering segment is extending from the other end of the lower-row connecting segment to protrude out of the base portion; and a metallic shell defining a receptacle cavity therein, wherein the insulated housing is in the metallic shell, and the metallic shell comprising:

a top cover plate located atop the base portion and the tongue portion;

a rear cover plate extending from the rear side of the top cover plate downwardly along the rear side of the base portion and the rear cover plate comprising a bottom edge and a bent sheet substantially perpendicular to an outer wall of the rear cover plate and extended outward from the outer wall of the rear cover plate; and a plurality of pins, wherein a part of the pins extend downwardly from the bottom edge of the rear cover plate, and a part of the pins extend downwardly from the bent sheet.

2. The electrical receptacle connector according to claim 1, wherein the part of the pins are located at two sides of the rear cover plate, and the part of the pins are soldered on the circuit board.

3. The electrical receptacle connector according to claim 2, wherein the pins are horizontal pins or vertical pins.

4. The electrical receptacle connector according to claim 1, wherein the upper-row soldering segments and the lower-row soldering segments are horizontal pins or vertical pins.

5. The electrical receptacle connector according to claim 1, wherein the bent sheet is extending out of the outer wall of the rear cover plate by a certain length, and the certain length is less than or equal to 1 mm.

6. The electrical receptacle connector according to claim 1, wherein the upper-row soldering segments and the lower-row soldering segments are adjacent to the bottom of the bent sheet, a distance between the upper-row soldering segments and the bent sheet is less than or equal to 0.4 mm, and a distance between the lower-row soldering segments and the bent sheet is less than or equal to 0.4 mm.

7. The electrical receptacle connector according to claim 1, wherein the bent sheet comprises a corner located at an end portion of the bent sheet, and the corner comprises a bottom edge.

8. The electrical receptacle connector according to claim 7, wherein a distance between the upper-row soldering segments and the bottom edge of the corner is less than or equal to 0.2 mm, and a distance between the lower-row soldering segments and the bottom edge of the corner is less than or equal to 0.2 mm.

9. The electrical receptacle connector according to claim 7, wherein a distance between the bottom edge of the corner and the circuit board is less than or equal to a range from 0.2 mm to 0.5 mm.

10. The electrical receptacle connector according to claim 1, wherein the upper-row plate signal terminals are at the upper surface for transmitting first signals, the lower-row plate signal terminals are at the lower surface for transmitting second signals, the specification for transmitting the first signals is conform to the specification for transmitting the second signals, the upper-row plate terminals and the lower-row plate terminals are point-symmetrical with a central point of the receptacle cavity as the symmetrical center.

11. The electrical receptacle connector according to claim 10, wherein the position of the upper-row plate terminals corresponds to the position of the lower-row plate terminals.

12. The electrical receptacle connector according to claim 1, wherein the metallic shell is located at a circuit board, and a distance between the bottom edge of the rear cover plate and the circuit board is less than or equal to 1.0 mm.

13. The electrical receptacle connector according to claim 1, wherein the part of pins extend from the middle portion of the bent sheet.

14. The electrical receptacle connector according to claim 7, wherein the part of pins directly extend from the bottom edge of the corner.

15. An electrical receptacle connector, comprising:

an insulated housing comprising a base portion and a tongue portion extending from one side of the base portion, and the tongue portion comprising an upper surface and a lower surface;

a plurality of upper-row plate terminals comprising a plurality of upper-row plate signal terminals, at least one upper-row plate power supply terminal, and at least one upper-row plate ground terminal, wherein each of the upper-row plate terminals is held on the base portion and the tongue portion and is at the upper surface of the tongue portion, wherein each of the upper-row plate terminals comprises an upper-row contact segment, an upper-row connecting segment, and an upper-row soldering segment, the upper-row connecting segment is at the base portion and the tongue portion, the upper-row contact segment is extending from one of two ends of the upper-row connecting segment to be at the upper surface, and the upper-row soldering segment is extending from the other end of the upper-row connecting segment to protrude out of the base portion;

a plurality of lower-row plate terminals comprising a plurality of lower-row plate signal terminals, at least one lower-row plate power supply terminal, and at least one lower-row plate ground terminal, wherein each of the lower-row plate terminals is held on the base portion and the tongue portion and is at the lower surface of the tongue portion, wherein each of the lower-row plate terminals comprises a lower-row contact segment, a lower-row connecting segment, and a lower-row soldering segment, the lower-row connecting segment is at the base portion and the tongue portion, the lower-row contact segment is extending from one of two ends of the lower-row connecting segment to be at the lower surface, and the lower-row soldering segment is extending from the other end of the lower-row connecting segment to protrude out of the base portion; and a metallic shell defining a receptacle cavity therein, wherein the insulated housing is in the metallic shell, and the metallic shell comprising:

a top cover plate located atop the base portion and the tongue portion;

a rear cover plate extending from the rear side of the top cover plate downwardly along the rear side of the base portion and the rear cover plate comprising a bent sheet substantially perpendicular to an outer wall of the rear cover plate and extended outward from the outer wall of the rear cover plate; and a plurality of pins extending downwardly from the bent sheet.

16. The electrical receptacle connector according to claim 15, wherein the bent sheet comprises a corner located at an end portion of the bent sheet, and the corner comprises a bottom edge.

17. The electrical receptacle connector according to claim 15, wherein the plurality of pins extend from the middle portion of the bent sheet.

18. The electrical receptacle connector according to claim 16, wherein the plurality of pins extend from the bottom edge of the corner.

19. The electrical receptacle connector according to claim 15, wherein the bent sheet is formed as an elongated plate and has a width greater than a width of each pin.

* * * * *